United States Patent [19]

Peart et al.

[11] Patent Number: 5,052,053

[45] Date of Patent: Oct. 1, 1991

[54] GARMENT FOR AQUATIC ACTIVITIES HAVING INCREASED ELASTICITY AND METHOD OF MAKING SAME

[75] Inventors: Stephen Peart; Bradford D. Bissell, both of Los Gatos, Calif.

[73] Assignee: O'Neill, Inc., Santa Cruz, Calif.

[21] Appl. No.: 462,660

[22] Filed: Jan. 9, 1990

Related U.S. Application Data

[63] Continuation-in-part of Ser. No. 279,854, Dec. 5, 1988.

[51] Int. Cl.[5] ..... A62B 17/00

[52] U.S. Cl. ..... 2/2.1 R; 2/2.1 A; 2/243 R

[58] Field of Search ..... 2/2.1 A, 2.1 R, 243 A, 2/243 R; 428/163, 167, 172

[56] References Cited

U.S. PATENT DOCUMENTS

| | | | |
|---|---|---|---|
| 237,141 | 2/1881 | Tasker | 2/2.1 R |
| 1,756,083 | 4/1930 | Brenner | 2/243 R |
| 2,966,155 | 12/1960 | Krupp | 2/2.1 R |
| 2,967,305 | 1/1961 | White | 2/2.1 A |
| 2,989,324 | 6/1961 | O'Halloran | 2/2.1 R |
| 3,042,926 | 7/1962 | Shepard | 2/2.1 A |
| 3,534,407 | 10/1970 | Barthlome | 2/2.1 A |
| 3,731,319 | 5/1973 | O'Neill | 2/2.1 R |
| 4,146,933 | 4/1979 | Jenkins | 2/2.1 A |
| 4,151,612 | 5/1979 | Vykukal | 2/2.1 A |
| 4,293,957 | 10/1981 | Melarvie | 2/2.1 R |
| 4,596,054 | 6/1986 | MacKendrick | 2/2.1 A |
| 4,599,075 | 7/1986 | Nygard | 2/2.1 R |

FOREIGN PATENT DOCUMENTS

| | | | |
|---|---|---|---|
| 1023690 | 1/1958 | Fed. Rep. of Germany | 2/2.1 R |
| 3616890 | 11/1987 | Fed. Rep. of Germany | 2/2.1 R |
| 70023 | 6/1969 | German Democratic Rep. | 2/2.1 R |
| 250188 | 9/1926 | Italy | 2/2.1 R |
| 53491 | 3/1985 | Japan | 2/2.1 R |
| 974426 | 11/1964 | United Kingdom | 2/2.1 R |

*Primary Examiner*—Werner H. Schroeder
*Assistant Examiner*—Diana L. Biefeld
*Attorney, Agent, or Firm*—Flehr, Hohbach, Test, Albritton & Herbert

[57] ABSTRACT

An aquatic garment, such as a wet suit or dry suit formed of a water-impervious material having a thickness dimension sufficient to provide thermal insulation for a user during aquatic activities. The garment includes stretch areas having an array of grooves with a depth dimension sufficient to significantly increase the elasticity of the garment transverse to the grooves while maintaining the mechanical integrity and thermal insulation in the stretch area. Variation in the elasticity and in the direction or orientation of enhanced elasticity can be achieved by varying the spacing and direction along which the grooves extend. A method for formation of grooved aquatic garments to enhance their stretchability also is disclosed.

27 Claims, 6 Drawing Sheets

GARMENT FOR AQUATIC ACTIVITIES HAVING INCREASED ELASTICITY AND METHOD OF MAKING SAME

RELATED APPLICATION

This application is a continuation-in-part application based upon co-pending U.S. patent application Ser. No. 07/279,854, filed Dec. 5, 1988, entitled GARMENT FOR AQUATIC ACTIVITIES AND METHOD OF MAKING SAME.

TECHNICAL FIELD

The present invention relates, in general, to garments such as wet suits, dry suits or the like which are used for board surfing, wind surfing, water skiing, diving, sailing and various aquatic activities. More particularly, the aquatic garment and method of the present invention relate to wet suits and dry suits, which include areas of substantially increased elasticity with attendant increased flexibility and methods of constructing the same.

BACKGROUND ART

Garments which provide thermal insulation to the wearer during a variety of aquatic sports or activities are well known. Two broad types of aquatic garments are extensively used, namely, wet suits and dry suits. As the name implies, wet suits usually permit the entry of some water between the garment and the user's body. Wet suits greatly restrict the circulation of the water, however, so that the water inside the suit warms up as a result of contact with the user's body. It is the combination of the thermal insulation of the wet suit material and the thermal insulation of the warmed water inside the suit which is effective in thermally protecting the wearer of the suit against cold water.

Dry suits are formed with seals which seal the suit against the user's skin at the ankles, wrists and neck of the user. Dry suits are constructed one of two ways. A single layer of material is simply sealed to the user, for example, as shown in U.S. Pat. No. 3,731,319, or two spaced apart layers are employed which form a pneumatic bladder that can be inflated to surround the user with a layer of air. Dry suits, for activities such as board or wind surfing, are often formed as single layer dry suits, while two layer dry suits are more typically used for scuba diving. The trapped air in a dry suit, together with the thermal insulating properties of the layer or layers of material, provide the necessary thermal insulation for the dry suit.

Both wet suits and dry suits typically are formed from foamed plastic or rubber sheet material, most typically foamed neoprene. This rubber sheet material usually will have a fabric layer, often a nylon fabric, bonded to one or both sides. The inside of a wet suit, for example, will usually have nylon fabric bonded to the foamed neoprene to provide additional strength and to provide a more comfortable surface against the wearer's skin.

Wet suits may be constructed as full length, single piece suits or two-piece suits with separate tops and bottoms. Some suits have shortened arms and legs, and in warmer water, the user may wear just the wet suit top.

Wet and dry suits are formed from a plurality of pieces of rubber sheeting that are glued, taped and sewn together to form a garment which closely conforms to the user's body. They inherently, therefore, have a certain number of seams between pieces which seams tend to reduce the elasticity and flexibility of the suit.

In many aquatic activities, and particularly aquatic sports, it is highly desirable to have the thermal insulating garment be as stretchable and flexible as possible, while still maintaining the necessary thermal insulating properties. For board surfing, for example, the surfer must paddle the surf board out through the waves, which requires considerable upper body, and particularly arm, motion. Scuba diving requires considerable leg motion, and, to a lesser degree, arm motion. Similarly, wind surfing demands flexibility of both the arms and legs for manipulation of the boom, mast and board.

As the need for thermal insulation increases, the thickness of the suit material must be correspondingly increased. Thus, the suits which are employed for cold water aquatic activities often are constructed with a neoprene thickness (for example, up to five millimeters thick) that substantially inhibits the stretching and bending which would normally be required to participate in the activity. Prior wet and dry suits, therefore, whether for diving or for surfing, have tended to be undesirably inelastic and stiff.

One approach to the problem of lack of elasticity and flexibility has been to form the wet and dry suits with selected areas of increased elasticity and flexibility. This heretofore has been accomplished by joining areas of relatively thin suit material to sheets of relatively thicker suit material. Thus, the areas of the suit which should be most flexible or stretch the most, for example, the upper arms, shoulders, waist and thighs are formed of patches or areas of relatively thin suit material. This approach is shown in FIG. 1 of the drawing.

In FIG. 1 a sheet 21 of neoprene foam has nylon fabric layers 22 and 23 bonded to the inner and outer surfaces of the foam. Mounted in abutting relation to sheet 21 is a second sheet 24 of foamed neoprene having layers 26 and 27 of nylon bonded to the inner and outer surfaces. As will be seen, sheet 24 has significantly less thickness than sheet 21. The two neoprene pieces are secured together by gluing (adhesive or solvent gluing) at interface 28, and a seam reinforcing tape 29 is glued to both sheets on an inside of the assembly. As also will be seen, the disparity in sheet thickness forces a discontinuity or step 31 at the seam. Discontinuity 31 affects the comfort, elasticity and flexibility of the suit.

A cold water wet or dry suit suitable for wind surfing or board surfing typically has a fabric thickness of about 3 to 3 ½ millimeters of neoprene foam material. In order to enhance the elasticity and flexibility of the suit, areas of 1 millimeter foam material can be used in the armpits and areas of 2 millimeter foam material used at the elbows and waist. As the area of such patches of reduced thickness foam is increased, however, there is a noticeable reduction in the thermal insulation properties of the suit. Accordingly, these stretch areas must be somewhat limited in size and located only in the critical portions of the suit. As will be appreciated, however, most aquatic activities require stretching and flexing of many areas of a user's body, and enhancing elasticity and flexibility in only a limited number of areas still does not truly solve the problem.

Another problem which occurs in connection with using areas or patches of reduced thickness foam material is that the number of seams in the suit increases in order to permit areas of differing foam thickness. Thus, seams having taped backing 29 and resulting discontinuities 31 tend to defeat the desired goal of increased suit stretching. Accordingly, in suits using a variation of the thickness of the rubber sheet material to enhance elasticity and flexibility, there is a significant loss of flexibility and stretch at the seams around the stretch areas.

In addition to the desirability of making wet and dry suits more flexible during use in an aquatic activity, the inelasticity of the thicker, more thermally insulating suits, also poses a problem when getting into and out of the suit. Even in wet suits, it is highly desirable and necessary to limit the circulation of water between the inside and the outside of the suit. Thus, in both wet and dry suits the wrists, ankles and neck all tend to be tight fitting so that cold water cannot easily enter the suit. One particularly effective way of creating a seal between the suit and the user is disclosed in U.S. Pat. No. 3,731,319. In the suit of this patent, the cuffs and collar of the suit are tapered or narrowed, and they are folded inwardly upon themselves to produce a good seal between the user's body and the suit. Bands of elastic material are also sometimes used to enhance the seals further.

When the user attempts to get in or out of a wet or dry suit, however, the narrowed legs and arms tend to make it somewhat difficult to force the feet and hands through the narrowed openings. This difficulty increases as the wet suit material becomes thicker, and it is further compounded if the user is wearing a Lycra garment under the wet suit, which often is the case. Since wet suits are usually donned and removed at locations such as beaches or moving boats, inelastic wet and dry suits can require significant and undesirable struggling and inconvenience to the user as the suit is put on and taken off.

While not significantly enhancing the elasticity of wet suits some neoprene sheets are foamed in molds having surface puckers or dimples. This surface dimpling is referred to as a "Sharkskin" surface, and it originally was devised to have the cosmetic effect of hiding surface blemishes which are sometimes apparent in smooth skinned neoprene sheets. More recently, the effect of Sharkskin puckers in enhancing suit flexibility and surface "softness" has been recognized.

Various Sharkskin dimple patterns have been used, but they include recesses or dimples having a depth less than 15 percent of the thickness of the thickness of the foamed neoprene sheet, and typically less than 10% of the sheet thickness. Accordingly, Sharkskin dimpling of foamed neoprene does not significantly effect the elasticity or stretchability of the neoprene sheet, and its effect on suit flexibility is not nearly as significant as would be desired optimally. The dimple pattern in Sharkskin also extends uniformly over the entire surface of the Sharkskin. Thus, to gradiate or tailor even the small amount of increased flexibility provided by Sharkskin in accordance with the areas that need to flex, the suit must be constructed with patches or areas of Sharkskin, with additional seams that reduce flexibility and elasticity.

Very recently wet suits have been constructed of a foamed neoprene material which is subject to a heat compression process after foaming to form grooves or recesses in the foam. Thus, the sheet of neoprene foam is placed in a heated die after foaming and squeezed to groove the foam.

The effect of this post-foaming compression technique is to crush the foam cells in the area of the grooves and increase the material density in the area of the grooves. Unfortunately, this process causes the neoprene in the area of the grooves to have significantly reduced thermal insulating properties as a result of cell crushing, and the elasticity of the sheet across the grooves also is reduced significantly.

Post-foaming, heat grooving of neoprene, therefore, does not lend itself to constructing wet or dry suits with enhanced elasticity, and it results in undesirable thermal degradation.

Accordingly, it is an object of the present invention to provide an aquatic garment, such as a wet suit, dry suit or the like, which has enhanced elasticity while still maintaining sufficient thermal insulation for aquatic activities in cold water.

It is another object of the present invention to provide a wet suit or dry suit which has the desired thermal insulation and yet had gradiated stretchability in selected areas.

Still another object of the present invention is to provide an aquatic garment, and method for making the same, in which stretchability and flexibility both can be significantly enhanced and varied in virtually any part of the garment without reducing the thermal insulation below level which is sufficient for aquatic us of the garment.

Still another object of the present invention is to provide a garment, such as a wet suit, dry suit or the like, and a method for constructing the garment, which are effective in increasing the garment elasticity without undesirably reducing the mechanical integrity of the garment.

Another object of the present invention is to provide a wet suit or dry suit, and method of making the same, which makes the suit easier for the wearer to get into and get out of.

Still a further object of the present invention is to provide a more elastic and flexible wet suit or dry suit which is durable, suitable for use in a wide range of aquatic activities, can be constructed using conventional fabricating techniques, minimizes the number of seams between adjacent garment areas, and is suitable for use with one and two-piece suits.

The garment for aquatic activities, and the method for making the garment of the present invention, have other objects and features of advantage which will become apparent from the drawing and/or are set forth in more detail in the following description of the Best Mode Of Carrying Out The Invention.

DISCLOSURE OF THE INVENTION

The garment of the present invention is formed of a substantially water-impervious material having a thickness dimension sufficient to provide thermal insulation for a user during aquatic activities. The improvement in the garment comprises, briefly, forming the garment with at least one stretch area having a groove or grooves sufficient in depth to significantly increase the stretchability, and additionally the flexibility of the garment in the area of the grooves. The increased stretchability and flexibility are achieved by selecting the depth, width and orientation of the grooves to produce the desired result while still maintaining mechanical integrity and sufficient thermal insulation in the stretch area to permit active use of the garment in aquatic activities. In the most preferred form, the garment is a wet suit or dry suit formed of a bendable sheet of closed-cell neoprene foam having a reinforcing knit fabric, such as nylon, bonded to one side of the foam sheet. The grooves are formed without destroying the cell integrity at the bottoms of the grooves, and the grooves extend from an opposite side of the foam sheet toward, but preferably not to, the reinforcing nylon fabric. The width, depth, spacing and orientation of the grooves can be selected to gradiate or vary the stretchability and flexibility of the garment without adding seams to the garment.

The method of increasing the elasticity of an aquatic garment of the present invention is comprised, briefly, of forming an area of a sheet of water-impervious bendable thermal insulating material with one or more grooves, which are preferably, but not necessarily, in side-by-side relationship and extend from a side of the sheet to a depth less than the thickness of the sheet. The method is accomplished without destroying the insulating properties of the foam between the bottoms of the grooves and the opposite side of the sheet. Most preferably grooving is achieved during foaming of the neoprene by using a mold with a ridge pattern which produces the grooves in the foam, but grooving also may be accomplished by a cutting process in which a laser or other cutting device is employed in a post-foaming process which does not crush or destroy cells at the bottoms of the grooves.

BEST MODE OF CARRYING OUT THE INVENTION

The present invention is directed to the substantial enhancement of the stretchability or elasticity of garments, such as wet or dry suits, with an attendant desirable secondary effect of increasing garment flexibility. While primarily directed toward garments useful in aquatic activities, the advantages of enhanced stretchability will accrue to other garments formed of thick and yet somewhat stretchable and flexible pieces of sheet material, such as foamed neoprene rubber.

Figure 2:
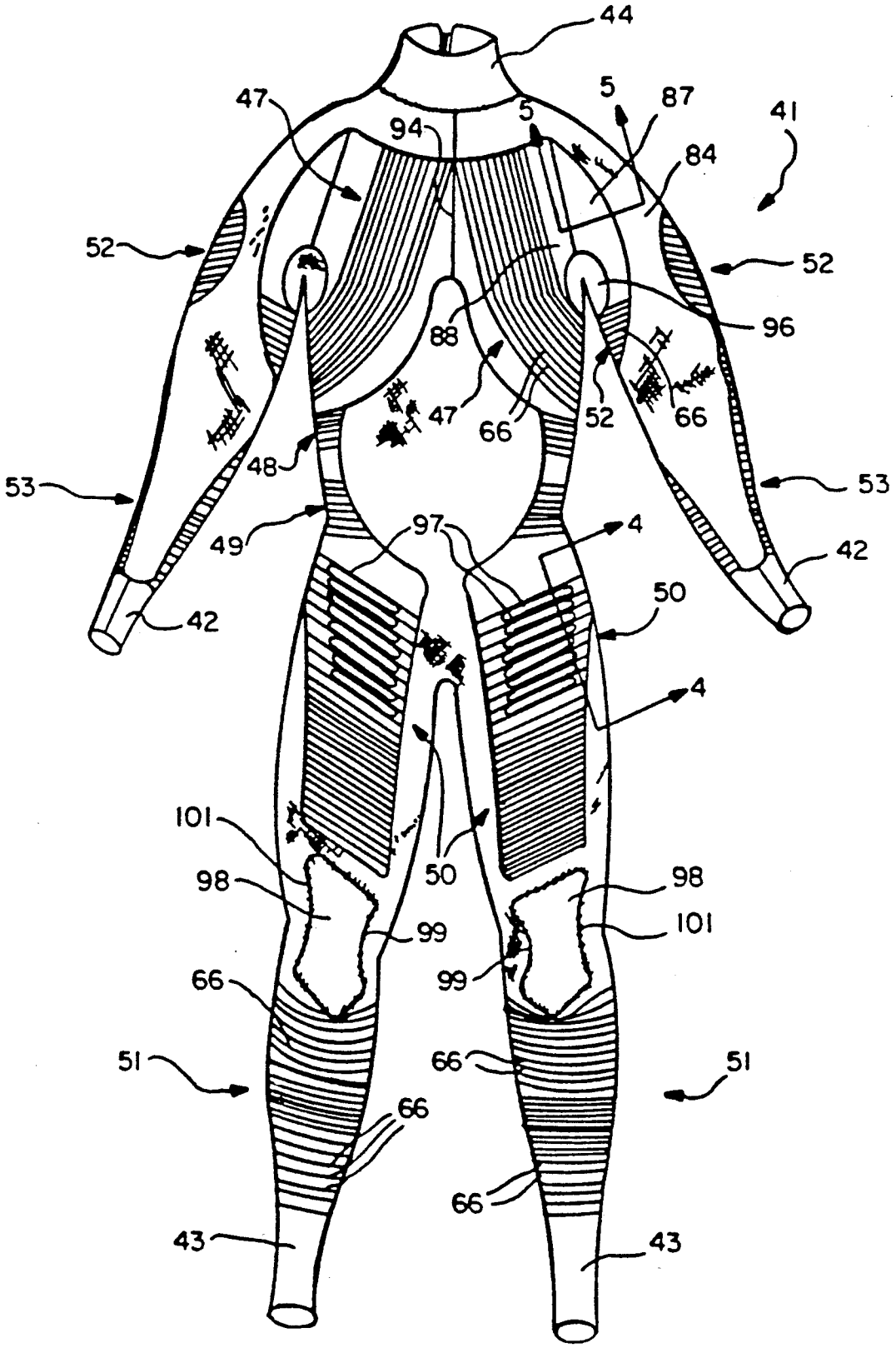
FIG. 2 is front elevation view of a garment constructed in accordance with the present invention.
Figure 3:
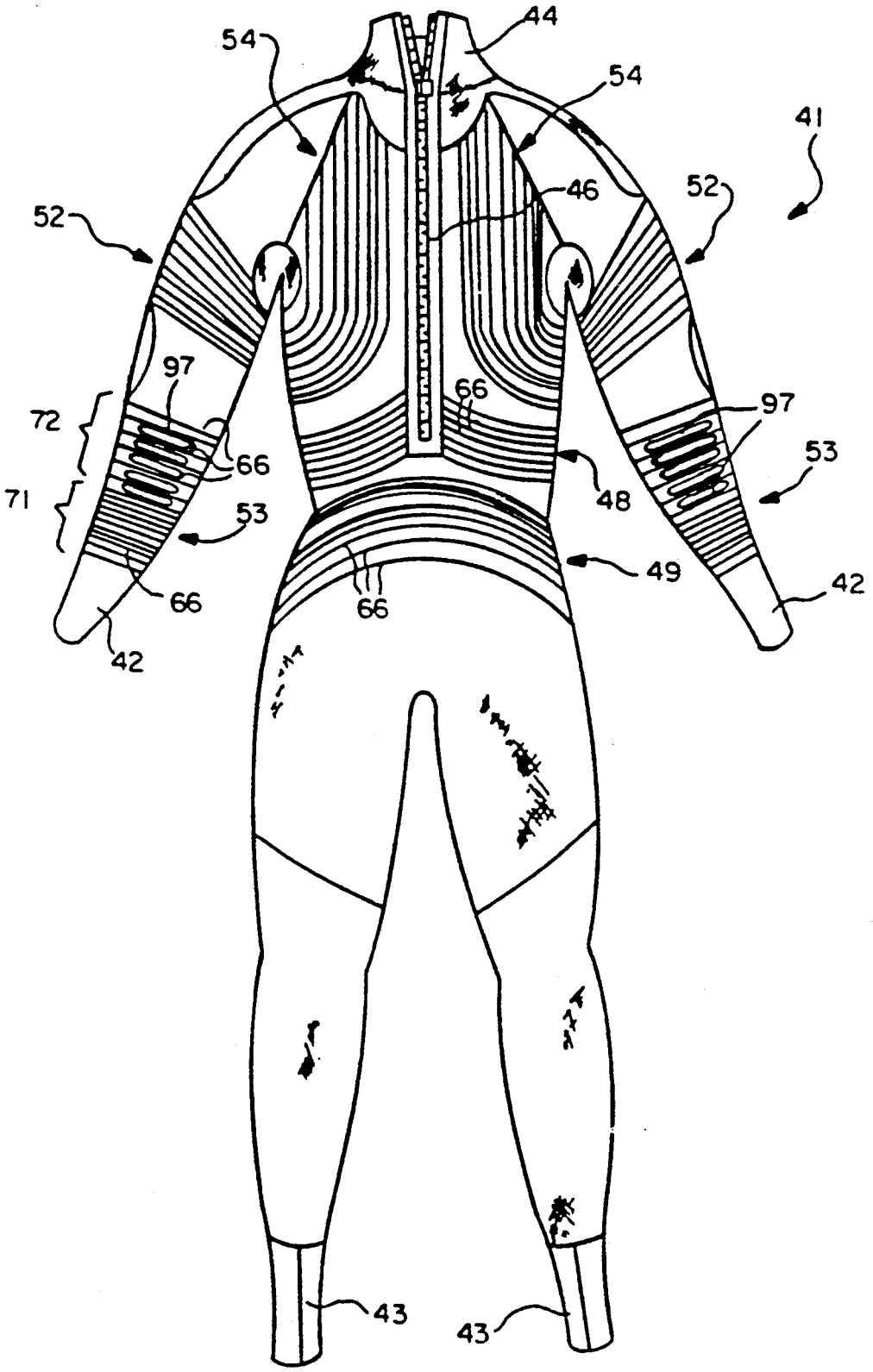
FIG. 3 is a rear elevation view of the garment of FIG. 2.

As best may be seen in FIGS. 2 and 3, the garment of the present invention, generally designated 41, may be a wet suit or dry suit having wrist receiving cuffs 42 and ankle receiving cuffs 43, as well as collar 44. The wrist and ankle cuffs and collar all are relatively narrowed so as to form at least a partial seal with the skin of the wearer of the garment. If garment 41 is to be a dry suit, the cuffs 42 and 43 and collar 44 are all preferably rolled inside on themselves to seal against the entry of water, as described in more detail in U.S. Pat. No. 3,731,319. If garment 41 is to be a wet suit, cuffs and collar are still narrowed, but an absolute seal between these elements and the user is not necessary and some entry of water into the suit is contemplated. In wet suits it is only essential that the water circulation rate be very low so that water is trapped inside the suit for a sufficient time to be warmed by the user's body without the expenditure of too much energy.

Suit 41 further will include zipper assembly 46 which extends down the back, as shown in FIG. 3, or across the shoulders, as shown in U.S. Pat. No. 3,731,319. If the garment is a dry suit, the zipper assembly 46 will be substantially impervious to the entry of water. If suit 41 is a wet suit, some leakage of water around zipper assembly 46 and into the suit can be tolerated.

In the improved aquatic garment of the present invention, a plurality of stretch areas are provided in the suit to enhance extensibility or elasticity of the suit and, accordingly, enhance aquatic activities undertaken in the suit. As shown in FIGS. 2 and 3, suit 41 includes a pair of stretch areas 47 which cover the user's chest, and upper stretch area 48 at the user's waist, a lower stretch area 49 for the user's waist and hips, a pair of elongated stretch areas 50 superimposed over the user's thighs, stretch areas 51 over the user's shins, stretch areas 52 over the user's upper arms, a pair of stretch areas 53 between the elbow and the user's wrists, and finally a pair of stretch areas 54 in the user's back on either side of zipper assembly 46.

In the suit of the present invention each of the stretch areas 47–54 are formed with surface discontinuities or groove means in the sheet material forming garment 41 that diminish the strength or ability of the sheet material to resist stretching and also flexing. More particularly, stretch areas 47–54 preferably take the form of an array of slits or grooves 66 which have a depth dimension which is sufficiently deep relative to the thickness of the material forming the garment to significantly increase the elasticity of the material. This significant elasticity increase is achieved while still maintaining the mechanical integrity of the material and while maintaining sufficient thermal insulation in stretch areas 47–54 to permit use of the garment in aquatic activities.

Prior art surface dimpling, as is found in Sharkskin as it has been sold in the past, is so superficial or insubstantial in depth relative to the material thickness as compared to the grooved material of the present invention that the effect of such dimpling can be said to be insignificant. Sharkskin, for example, typically has dimples that are 10 to 15 percent of the sheet thickness. In the wet and dry suits of the present invention grooves 66 extend to a depth of at least twenty five percent and more typically between about 40 percent to about 80 percent of the thickness of the sheet of material. In fact in some applications, for example, in FIG. 6A, the grooves 167 may extend to 90 percent or more.

As used herein, therefore, the expression "significantly increase the elasticity" shall mean grooves which have a depth sufficient to increase elasticity transverse to the groove means substantially in excess of that possible using surface dimpling and preferably of an increase in elasticity of at least twenty five percent. Most preferably an increase in elasticity of about fifty percent or more is achieved. As will be seen in the example below, increases in elasticity of more than 100 percent under moderate loading have been achieved.

Figure 6:
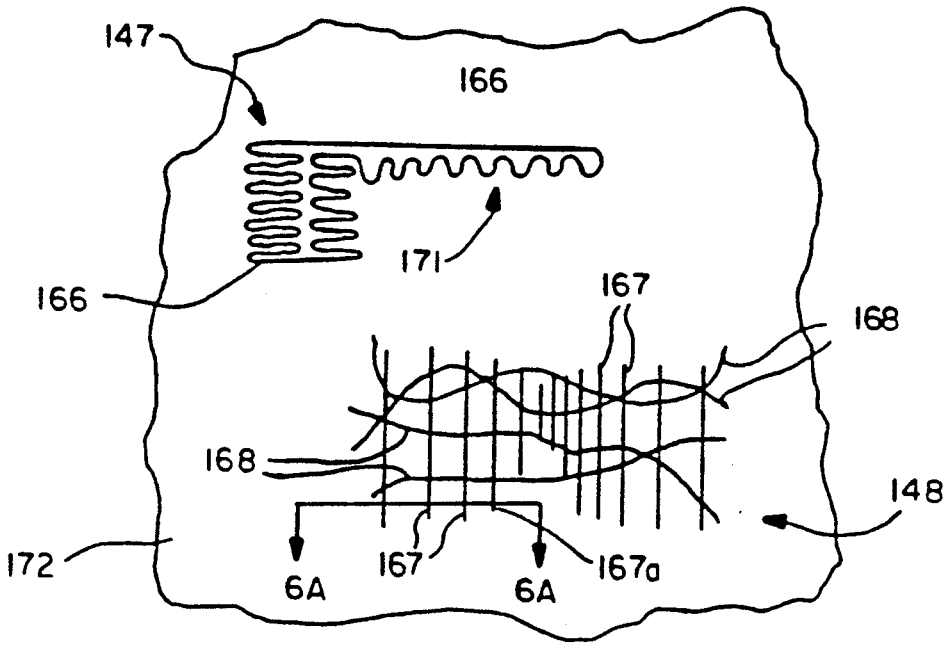
FIG. 6 is a top plan view of an area of an alternative embodiment of the aquatic garment of the present invention showing two different stretch area groove patterns.

As used herein, the expressions "elasticity" and "stretchability" shall mean the ability of the material to be stretched or extended below the elastic limit of the material in a direction generally transverse to the longitudinal axis of grooves 66. Thus, if substantially enhanced elasticity is required in two dimensions, grooves extending in relatively transverse directions, as shown in FIG. 6, are desirable.

In FIGS. 2 and 3, the orientation of grooves 66 has been selected to provide the desired orientation of enhanced stretching and bending which will be most useful in aquatic sports. Stretch areas 47 and 54 have vertical grooves 66 which allow radial expansion of the suit in the chest area to facilitate breathing and then are horizontal proximate the arm pits to enhance longitudinal stretching for ease of arm motion. Stretch areas 48 and 49 are horizontal to permit bending forward at the waist, i.e., fabric vertical stretch along the back. Similarly, stretch areas 50 facilitate bending of the thighs and areas 51 allow the feet to more easily pass down the legs and out ankle bands 43. Areas 52 and 53 have horizontally extending grooves to permit stretching for arm motion and ease insertion of the arms down the sleeves.

As will be appreciated, groove means suitable for imparting enhanced elasticity to garment 41 may take the form of a single continuous groove or a plurality of grooves. As will be seen in FIGS. 2 and 3, the groove means of the stretch areas 47–54 are provided by a plurality of side-by-side generally parallel grooves 66. In FIG. 6, however, the groove means in stretch area 147 is a continuous, or endless and randomly oriented or extending groove 166, while stretch area 148 in FIG. 6 shows a plurality of grooves 167 which are intersected by randomly extending grooves 168 to provide enhanced stretch in two directions in the same stretch area.

The details of construction of the stretch areas which have been incorporated into garment 41 can best be described by reference to FIGS. 4 and 4C. As will be seen, the sheet 61 of material forming the garment has a thickness dimension, T, which is selected to provide the desired amount of thermal insulation, depending upon the material of which sheet 61 is formed. Thus, conventionally in the construction of wet and dry suits, sheet 61 is a foamed, closed-cell neoprene rubber. It will be understood that other natural or synthetic rubbers and plastics can be employed in garments of the present invention, and they do not need to be foamed. Foaming, however, normally adds significantly to the thermal insulating qualities of the material.

It is also conventional in wet and dry suits to bond a layer 63 of stretchable reinforcing fabric, such as a nylon, and most particularly a knit nylon, to inside surface 62 of sheet 61. Fabric 63 also provides a better feel against the user's skin.

The outer surface 64 of sheet 61 of thermal insulating material is a continuous surface, as is shown in the areas of garment 41 not formed as stretch areas. In stretch areas 47–54, however, the continuity of outer surface 64 has been interrupted, preferably by a plurality of grooves 66 of substantial depth. The interruption of outer surface 64 by grooves 66 immediately enables sheet 61 to be more easily stretched.

Figure 4:
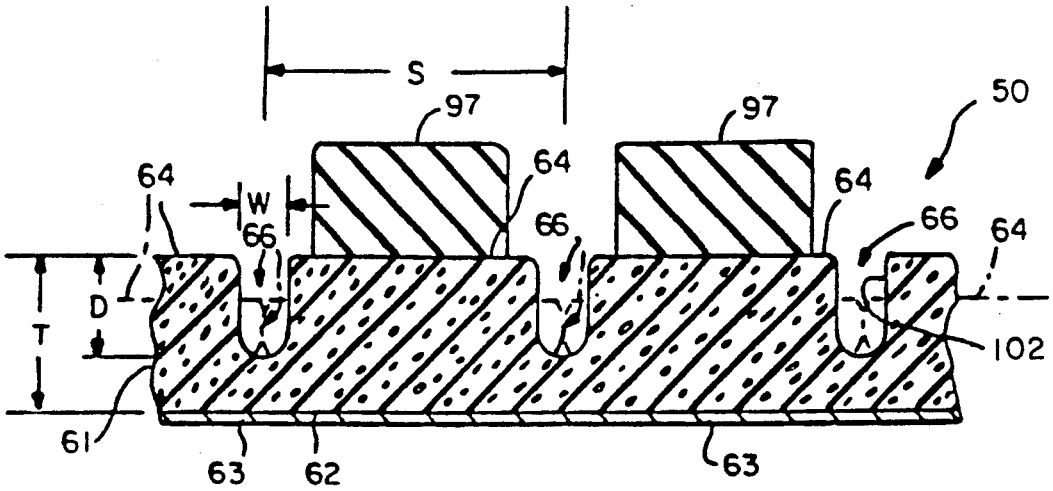
FIG. 4 is an enlarged, fragmentary, cross-section view taken substantially along the plane of line 4—4 in FIG. 2.
Figure 4A:
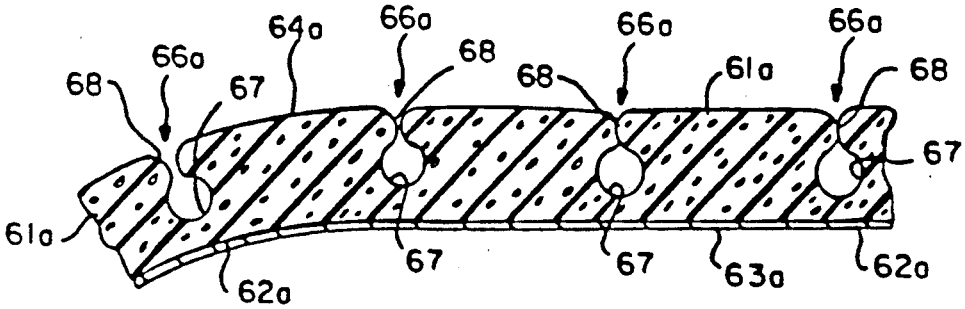
FIG. 4A is a cross section view corresponding to FIG. 4 of an alternative embodiment shown in a somewhat reduced scale.
Figure 4B:
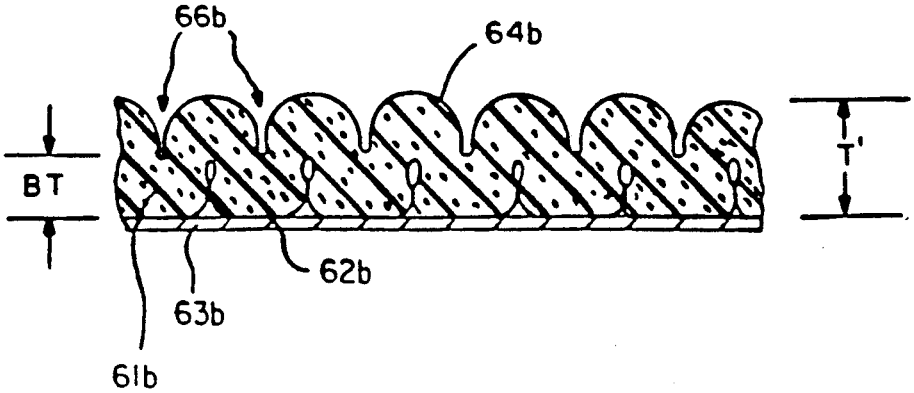
FIG. 4B is a cross section view corresponding to FIG. 4 of a further alternative embodiment shown in a somewhat reduced scale.
Figure 4C:
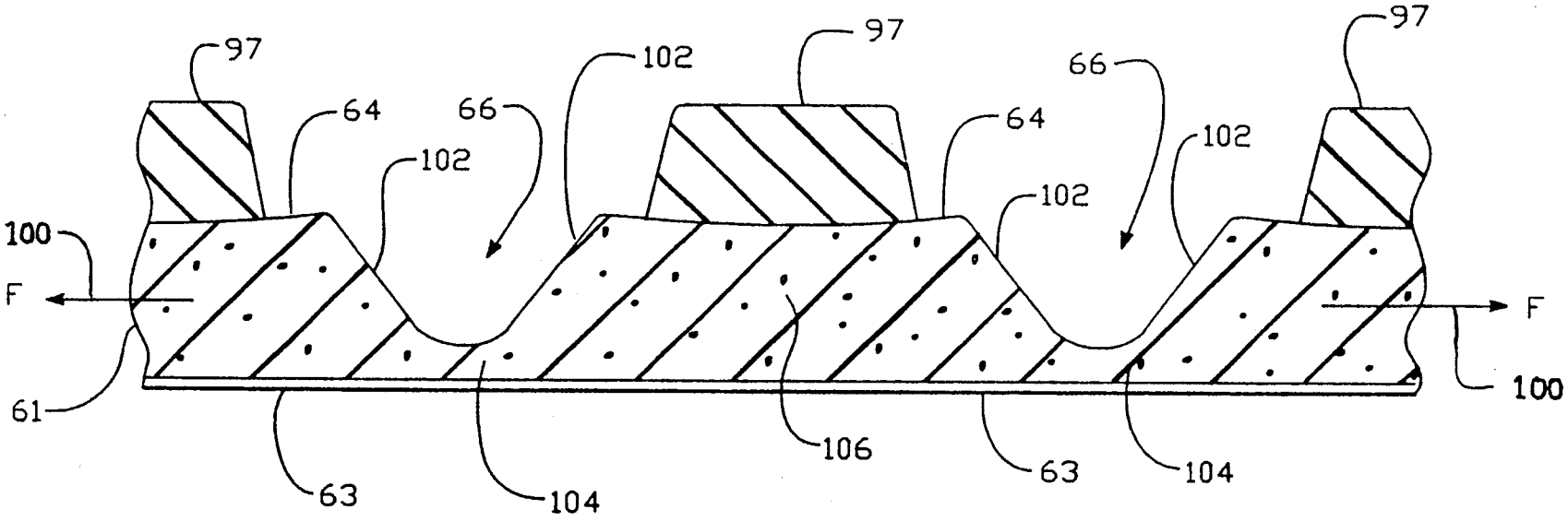
FIG. 4C is a cross section view corresponding to FIG. 4 with the sheet in a stretched condition.

As best may be seen in FIG. 4C, applying a tension force F transverse to the longitudinal axis of grooves 66, as shown by opposing arrows 100, causes the grooves to open up. Thus, side walls 102 of groove 66 have become skewed or outwardly inclined from their vertical positions of FIG. 4. The foam at the bottoms of grooves 66 in area 104 has elongated as a result of its reduced thickness, and the foam in the full thickness areas 106 and members 97 also have elongated, but to a lesser degree because of their increased thickness.

By forming grooves 66 to a depth, D, which preferably is less than the thickness, T, the resistance to stretching is enhanced by the ability of the grooves to open up and the ability of thinner areas 104 at the bottoms of the grooves to stretch. Additionally, the resistance to bending or the stiffness of sheet 61 now is determined by the bending characteristics of a sheet having a thickness which is the difference between thickness, T, and depth, D, rather than the resistance to bending for the full thickness, T, of sheet 61.

Since much of the resistance to stretching and bending is a function of tension along the outer surface 64, the width, W, of slits or grooves 66 can be relatively narrow, for example, about one millimeter, or even less. Any discontinuity, slit, notch or groove of significant depth into surface 64 will have an immediate effect of reducing resistance to stretching and bending which is inherent in sheet material 61. As the width, W, of grooves 66 increases, however, the area of the bottom of the grooves increases and thermal transfer through the bottom of the grooves to inner surface 62 and the wearer of the suit also increases. It is most desirable, therefore, to limit the width dimension of the grooves in order to achieve enhanced stretchability and flexibility without undesirable reduction in thermal insulation.

One of the advantages of maintaining the grooves 66 as relatively narrow slits accrues when the construction of FIG. 4 is used for suits for diving. As the suit is submerged in water, the sheet material 61 is compressed, for example, to the phantom line position in FIG. 4 which substantially closes grooves 66. Thus, when using the grooved garment of the present invention as a dive suit, relatively thin grooves will tend to close with increased depth, which correspondingly prevents heat loss through the grooves. This is important since the temperature of water normally will drop with depth, and yet while the discontinuity means 66 or grooves close, the suit is still stretchable since grooves 66 will open on tension loading or bending.

It is also important that grooves or discontinuities 66 afford stretchability to the suit in areas facilitating donning and removing of the suit. Grooves in stretch areas 51 enable a suit to stretch as the feet are urged down the legs and out through cuffs 43. The suit is not normally bent to any significant degree in the areas 51 of the user's shins, but stretching is required and helpful in donning the suit and urging the feet out through the legs and cuffs.

An alternative surface discontinuity construction which provides significantly increased garment stretchability is shown in FIG. 4A of the drawing.

A foam sheet material **61*a* is formed with a plurality of groove means 66*a*. Sheet 61*a* optionally includes a reinforcing knit fabric 63***a* on an inside thereof. In the form of the garment material shown in FIG. 4A, groove means 66*a* is formed by an enlarged longitudinally extending cavity portion 67 and neck 68. When the sheet 61*a* is in the flat condition, as shown at the right hand side of FIG. 4A, the neck 68 closes to a slit. As the sheet is stretched, or flexed so that surface 64*a* becomes convex as shown at the left hand side of FIG. 4A, the discontinuity in surface 64*a* opens up. Thus, there is little or no tension at surface 64*a* which resists stretching or convex flexing, and such stretching is merely resisted by the thickness of the material between the bottom of cavities 67 and the inner surface 62*a* of foam sheet 61*a*. In the closed or flat position shown at the right hand side of FIG. 4A, water is not free to circulate into cavity 67, and while water will get trapped in that cavity if the garment is submerged during stretching, such water will generally tend to be warmed up with time and heat transfer through the discontinuity means 66 to the inside of the suit or garment will be diminished as a result of having a closed neck 68.

Formation of a garment with grooves in the form of cavities having a closed neck can be accomplished by molding the sheet while in a curved condition. This will permit a mandrel neck to extend out from the cavity to the outside surface 64 of the sheet, and the enlarged mandrel heads used to form cavities 67 can be pulled outwardly from the body 61*a* of the sheet, since the foamed material is resilient and flexible. Once the curved sheet is laid flat, however, necks 68 all close.

It has been found that for most applications it is not necessary that grooves 66 have a closed mouth. The area of the grooves at the bottom is relatively small compared to the overall area of the garment. Grooves 66 have a width, W, in the range of about 0.5 to about 3 millimeters. Grooves 66, for example, may have a width of 2.0 millimeters. Grooves 66 have a spacing, S, between centers of between about 6 millimeters to about 20 millimeters. It is possible, however, to space groove 66 in the stretch arrays even farther apart. In fact, an important aspect of the garment of the present invention is that the stretchability of the garment can be gradiated or varied by varying the spacing, S, of the grooves in the arrays. The depth and orientation of the grooves and the location of the stretch areas also can be used to tailor the stretching effects to the desired use.

Figure 6A:
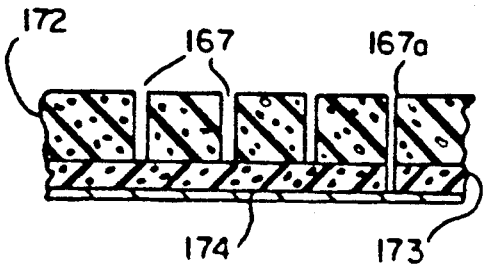
FIG. 6A is an enlarged, fragmentary side elevation view, in cross section, of the garment shown in FIG. 6, taken substantially along the plane of line 6A—6A in FIG. 6.

In FIGS. 6 and 6A continuous groove 166 has a branch or groove portion 171 which extends away from the main stretch area 147 to provide stretchability along a horizontal axis. In flex area 148, the center of the flex area has more closely adjacent grooves 167.

As best may be seen in FIG. 3, the lower portion 71 of grooves 66 in the wrist arrays 53 are relatively closely spaced together. The upper portion 72 of wrist array 53 has grooves which are spaced further apart. The arm of the garment, therefore, has enhanced stretchability in portion 72 of the array and even more enhanced stretchability in portion 71 of stretch area 53. This allows greater stretching of the garment proximate cuffs 42, which are restricted in diameter to effect a complete or partial seal. The cuffs themselves still preferably are not grooved, but the arms may be made somewhat more elastic to greatly facilitate donning of the wet suit. Similar elasticity is provided in shin flex areas 51. The thigh stretch areas 50, waist stretch areas 48 and 49 and shoulder stretch areas 52 and 54 are designed primarily to accommodate stretching of the suit during physical activity. The back, waist groove stretch areas 48 and 49, therefore, will easily accommodate and facilitate forward bending at the waist by the user. The stretch areas 52 and 54 are particularly useful in accommodating arm motions, and stretch areas 50 allow movement of the thighs during leg motion.

Still a further embodiment of the sheet of thermally insulating material suitable for use in forming wet suit garments or the like is shown in FIG. 4B. A sheet of thermally insulating foam rubber 61*b* is bonded to a fabric layer 63*b* along areas 62*b* of the inner surface of foam sheet 61*b*. Sheet 61*b* is bunched, pleated or accordion folded on itself so that there are what amount to grooves 66*b* or folds between adjacent bends of material 61*b* on itself. Over most of the area of the sheet of material shown in FIG. 4B, the effective foam layer thickness is T'. When the sheet is stretch transversely of the folds 66*b*, however, the folds open up and resistance to stretching is reduced to the thickness BT of the material. Thus, if a one millimeter sheet of foam rubber is laid up to have a thickness of T' equal to about 3 millimeters, the resulting composite sheet having the form of FIG. 4B is relatively stretchable and yet provides substantial thermal insulation.

As is conventional for wet and dry suits, the suits are formed of a plurality of pieces of sheet foam material which are secured together so as to conform the suit closely to a user's body. Additionally, seams are generally attempted to be located in areas where somewhat increased stiffness can be tolerated. Moreover, the selection of the configuration of the various foam pieces is sometimes dictated by aesthetic considerations and the desirability, for example, to include fabric layers of different colors at various locations over the suit.

Figure 1:
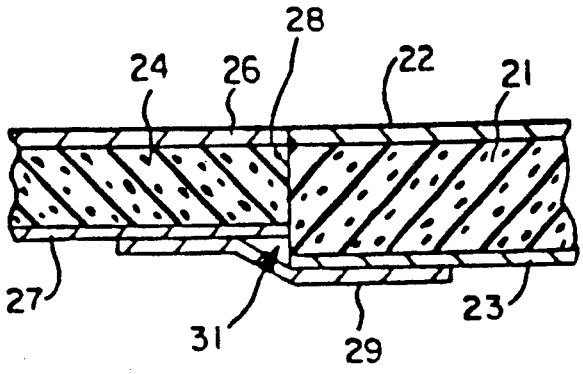
PRIOR ART FIG.-1
FIG. 1 is an enlarged, fragmentary, end elevation view in cross section of a seam between two pieces of an aquatic garment fabricated using a prior art construction technique.
Figure 5:
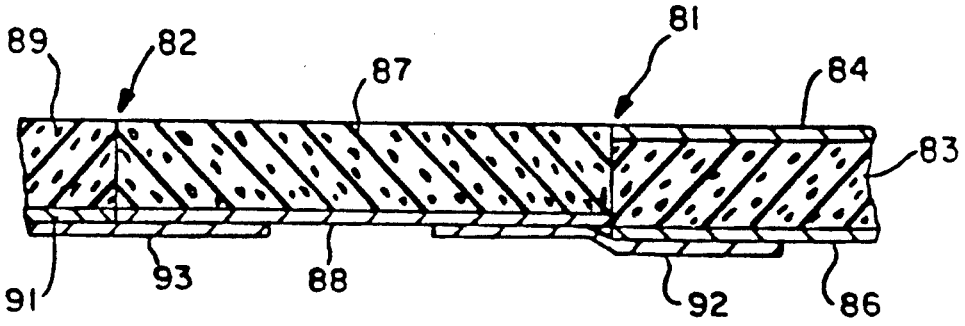
FIG. 5 is an enlarged, fragmentary, cross section view taken substantially along the plane of line 5—5 in FIG. 2.

The suit of FIGS. 2 and 3 is constructed by using a plurality of pieces. As can be seen in FIGS. 2 and 5, two seams 81 and 82 are shown joined together. Seam 81 is a seam between a foamed neoprene sheet 83 having nylon fabric 84 and 86 bonded to both surfaces thereof. At seam 81, sheet 83 is joined to a similar sheet 87 which has a nylon fabric layer 88 on the inside surface only. Sheet 87 is joined at seam 82 to a sheet 89 which similarly has an inner nylon layer 91 only. Both of seams 81 and 82 are adhesively secured along the abutting edges, and include fabric nylon tapes 92 and 93 which reinforce the glued seams. The piece 89 extends to a seam 94 (FIG. 2) and has array or stretch area 47 of grooves 66 formed therein. Joined to both foam pieces 87 and 89 is a gusset 96 which reinforces the arm pit. The lower end of sheet or piece 87 can be seen to include stretch area 52 with grooves 66. The selection and patterning of the pieces in the wet suit or dry suit of the present invention can be accomplished using standard well-known wet suit and dry suit forming techniques. The patterns of grooves in the various arrays, however, are most preferably formed in the grooves prior to fabrication of the completed garment.

The preferred method for forming grooves 66 in sheet 61 is to form the grooves during foaming of the foam rubber sheet. Foamed neoprene is formed by foaming the neoprene material in a "loaf" inside a die. If the die is provided with inwardly protruding veins or fins in opposite die surfaces, the opposite surfaces of the loaf will have grooves therein when the loaf is removed from the die. Usually both opposed surfaces will be formed during foaming with grooves 66 and then after foaming the loaf will be sliced into two or more pieces so that at least two of the resulting sheets of neoprene foam will be grooved on one side. The sliced or nongrooved side can have nylon fabric bonded to it and act as the inside of the garment.

It is preferable that grooves 66 be relatively thin, for example, 0.5 millimeters or even less, as opposed to 3 millimeters, but thinner grooves require thinner mold fins when grooves are formed during foaming, which reduces the mold durability. It has been found that fins about 2 millimeters in thickness can be used in a mold that has a high degree of durability. The enhancement of elasticity will occur, however, when grooves of much smaller width than 2 millimeters are used, for example if the grooves are cut into the foam material.

The substantial advantage of forming grooves 66 while foaming sheet 61 is that the foam cells at the bottoms of grooves 66 are not cut open, crushed or otherwise damaged or destroyed. Post-foaming, heat compression of grooves, for example, crushes and destroys the foam cells at the bottom of the grooves. In fact such post-foaming, heat compression both reduces elasticity across the grooves and increase thermal conductivity.

Another method to form grooves 66 is to employ laser cutting of the grooves after foaming. A laser cutting process has the advantage of enabling narrowing of the grooves, and accordingly, minimizing of the groove surface area to maximize the thermal insulation. Laser cutting does not crush the cells at the bottoms of the grooves, but it does open the top layer of cells and thereby very slightly reduce the thermal insulation.

As indicated in connection with FIG. 4B, grooves 66 also can be formed by an accordion-like securement of a foam rubber sheet to a backing fabric layer.

As best may be seen in FIG. 6A, the stretch groove means can include grooves or groove portions 167 which extend completely through the sheet of foam material 172. The garment of FIGS. 6 and 6A is formed by laminating or bonding together three sheets of material. Outer layer 172 has grooves 167 extending completely through the sheet. Inner water impervious sheet 173 prevents migration of water into the interior of the wet suit. However, it will be seen that groove **167*a* also extends through sheet 173. The innermost sheet 174 is most preferably a nylon which is not water impervious. Groove 167*a*, therefore, would provide a pathway for water into the suit, but sheet 174 could be treated to retard water transfer, or be a material which acts as a barrier, or simply allow a water transfer with a portion of groove 167*a*** extending to the interior of the suit. If groove portions extend through the full thickness of the garment material only a very limited area of the suit can be so formed, and such a construction is not preferred nor required for enhanced stretchability.

In order to provide further abrasion and padding, it is also possible to mount rubber members 97 to outside surface 64 of the foam rubber intermediate grooves 66, as best may be seen in FIGS. 2 and 4. Thus, on the upper thighs and just below the elbows, abrasion pads 97 are mounted intermediate grooves 66. The suit shown in the drawing also includes knee pad members 98 which have concaved inner edges 99 and 101. The knee pads are sewn to the garment and, together with the cut of the garment pieces are hardly effective in permitting convexed bending of the knees, even though they are not moved. The knee pads can be formed of a high abrasion resistant synthetic rubber, such as Kraton, but the pads are generally not formed of a foam material.

As will be apparent from the description of the wet suit of the present invention, the method for increasing the stretchability of an aquatic garment of the present invention is comprised of the step of forming an area of the garment with surface discontinuities or groove means, at least some of which extend into the material to a depth less than the thickness of the material. Most preferably, the material is a sheet of foam and the groove forming step is accomplished by cutting or molding during foaming the grooves into the material or laying up the material to provide the grooves. As will be understood, however, the advantages of enhanced elasticity are applicable to sheet material other than foamed rubber. Thus, natural or synthetic rubber and plastic sheets which are not foamed can benefit by the inclusion of surface discontinuities which interrupt the skin to a depth sufficient to significantly enhance stretching by opening up of the grooves and elongation of the reduced material thickness at the bottom of the grooves. It is possible to groove both sides of a sheet, or even to alternate the sides of the sheet from which adjacent grooves extend in order to enhance stretchability. In some applications placing groove 66 on the inside of the sheet is desirable to minimize heat transfer. When the grooves are on the interior of the suit, they are filled with air or water which has been warmed by the wearer's body as opposed to the ambient temperature water on the outside of the suit. In most applications, however, grooving from an outside surface of the sheet will provide the desired elasticity without loss of significant thermal insulating qualities.

As will be seen, therefore, the grooved wet suit or dry suit of the present invention can have an array of grooves which are gradiated and oriented to match the stretch required for the desired aquatic activity. This grooving significantly increases stretchability and flexibility without significantly degrading thermal insulating properties.

A sheet of about 3 millimeter thick foamed neoprene was formed with a plurality of side-by-side elongated grooves during foaming. The grooves were spaced on 6 millimeter centers and had a depth dimension of about 1.8 to 2 millimeters and a width of about 2 millimeters. Rubatex, closed-cell, foamed neoprene rubber was used, and a nylon jersey material was bonded to a side of the sheet opposite the grooves.

Stretchability of this sheet was compared to a similar ungrooved sheet of foamed Rubatex rubber having a thickness of 3 millimeters. 5.5, 11, and 16.9 kilogram loads were secured to both sheets and the extension in a direction perpendicular to the longitudinal center lines of the grooved sheet was measured. An equal length of 14.4 centimeters of each sheet was tested, and each sheet had the same width.

The ungrooved sheet stretched from 14.4 to 23.7, 30.6 and 34.4 centimeters, respectively, under the 5.5, 11 and 16.9 kilogram loads. The grooved sheet of wet suit material stretched from 14.4 to 33.8, 41.7 and 47.2 centimeters, respectively, under the same loads. This represents an increase in stretchability of 108 percent at 5.5 kilograms and about 68% at 11 and 16.9 kilograms as a result of material grooving.

What is claimed is:

1. In a garment formed of a substantially water-impervious material having a thickness dimension sufficient to provide thermal insulation for a user during aquatic activities, wherein the improvement in said garment comprises:

said material having a stretch area formed with groove means having a depth dimension in said material sufficient to significantly increase the elasticity of said material in said stretch area while maintaining the sufficient mechanical integrity and thermal insulation in said stretch area to permit use of said garment in aquatic activities, said material having a density between a bottom of said groove means and an opposite side of said material which is substantially the same as the density of said material in areas of said material other than said stretch area.

2. The garment as defined in claim 1, wherein,
said groove means has a depth dimension sufficient to increase the elasticity of said material by at least twenty five percent.

3. The garment as defined in claim 2 wherein,
said groove means has a depth dimension sufficient to increase the elasticity of said material by at least about fifty percent.

4. The garment as defined in claim 1 wherein,
said material is a bendable sheet of closed-cell foam.

5. The garment as defined in claim 1 wherein,
said material is a sheet of closed-cell neoprene foam having a substantially uniform density between a side of the material facing a bottom of said groove means and an opposite side of said sheet.

6. The garment as defined in claim 1 wherein,
said stretch area is located in an area of stretching of said garment during aquatic activities; and
said groove means in said stretch area are provided as a plurality of side-by-side grooves oriented to extend in a direction substantially parallel to a longitudinal axis of a frequent direction of stretching of the said garment by the user during said aquatic activities.

7. In a garment formed of a substantially water-impervious material having a thickness dimension sufficient to provide thermal insulation for a user during aquatic activities,
said material having a stretch area formed with groove means having a depth dimension sufficient to significantly increase the elasticity of said material in said stretch area while maintaining the sufficient mechanical integrity and thermal insulation in said stretch area to permit use of said garment in aquatic activities, wherein the improvement in said garment comprises:
said material is a sheet of bendable material having a thickness dimension of less than about 6 millimeters,
said groove means is provided as a plurality of side-by-side grooves formed in an outside of said material, and
a sheet of stretchable fabric is bonded to an inside of said material.

8. The garment as defined in claim 7 wherein,
said grooves are spaced apart from each other by a distance in the range of between about 6 millimeters and about 20 millimeters, and
said grooves have a depth in a range of about 25 percent to about 50 percent of said thickness dimension.

9. The garment as defined in claim 7 wherein,
said grooves have a width dimension in the range of about 2 millimeters and about 0.5 millimeters.

10. The garment as defined in claim 7 wherein,
said groove means include groove portions which extend to a depth penetrating through said material.

11. The garment as defined in claim 7 wherein,
said groove means is provided by a single endless groove.

12. The garment as defined in claim 7 wherein,
said groove means includes a plurality of intersecting groove portions.

13. In a garment formed of a substantially water-impervious material having a thickness dimension sufficient to provide thermal insulation for a user during aquatic activities, the improvement in said garment comprises:
said material having a plurality of grooves therein extending to a depth less than said thickness dimension of said material, at least some of said grooves being positioned in said material at non-uniform spacings from each other to vary the elasticity of said material over the area of said material.

14. The garment as defined in claim 13 wherein,
said grooves are elongated and extend in a direction orienting variation in the elasticity transversely of said grooves in a predetermined orientation.

15. In an aquatic garment formed if a substantially water-impervious material having a thickness dimension sufficient to provide thermal insulation for use in aquatic activities, the improvement in said garment comprising:
an area of increased stretchability oriented in a single predetermined direction,
said area of increased stretchability being provided by a plurality of side-by-side elongated grooves which enhance stretchability oriented in a direction transverse to said grooves, at least one of said grooves being spaced apart from others of said grooves by a distance which varies to provide variable enhanced stretchability transverse to said grooves.

16. A sheet of bendable material for use in the fabrication of a garment comprising:
a sheet of thermally insulating material having opposed surfaces and a thickness dimension between said surfaces providing a desired amount of thermal insulation; and
surface discontinuity means interrupting the continuity of at least one of said surfaces and penetrating said one of said surfaces sufficiently to enhance;
stretching of said sheet by at least twenty five percent.

17. A sheet as defined in claim 16 wherein,
said sheet of thermally insulating material is impervious to the passage of water therethrough, and
said surface discontinuity means is provided as a plurality of grooves in said one of said surfaces penetrating to a depth less than the thickness of said sheet.

18. A sheet as defined in claim 17 wherein,
said sheet is a foamed rubber sheet having a thickness in the range of about one millimeter to about five millimeters.

19. A sheet as defined in claim 17 wherein,
said surface discontinuity means is formed as a pair of abutting surfaces defining a slot when said material rests on a flat surface.

20. A sheet as defined in claim 17 wherein,
said surface discontinuity means is provided by pleats in said material and a side of said material opposite said surface discontinuity means is secured to a reinforcing sheet.

21. A method of increasing the stretchability of an aquatic garment or the like formed from an elastic sheet or material having a thickness selected to provide sufficient thermal insulation for aquatic activities comprising the step of:

forming an area of said sheet of material with surface discontinuity means extending into said material from a surface thereof to a depth sufficient to significantly increase stretching of said sheet at said surface discontinuity, said forming step being accomplished by forming groove means in said sheet of material without changing the thermal conductivity of said material at the bottoms of said groove means.

22. The method as defined in claim 21 wherein, said forming step is accomplished by forming at least one groove into said material to a depth less than the thickness of said material during forming said material by a foaming process in a mold.

23. The method as defined in claim 21 wherein, said forming step is accomplished by cutting at least one groove into said material after said sheet is formed.

24. The method as defined in claim 21 wherein, said sheet is formed by foaming a foam rubber material in a mold formed to produce said discontinuity means during foaming of said material.

25. A suite for aquatic activities comprising:

a garment formed from pieces of stretchable closed-cell foam each having sufficient thickness to provide thermal insulation for aquatic activities, said garment having at least one area formed with groove means including at least one groove portion extending from an outside of said garment into said garment to a depth less than the thickness of said garment and to a depth sufficient to significantly increase stretchability of said garment in said area of said groove means;

at least one of said pieces of bendable closed-cell foam is secured to a layer of water impervious material, and said groove means includes a plurality of groove portions and at least one of said groove portions extends through the thickness of said closed-cell foam.

26. In a garment formed of a substantially water-impervious material having a thickness dimension sufficient to provide thermal insulation for a user during aquatic activities, said material having a stretch area located in an area of frequent stretching during use of said garment, said stretch area being formed with a plurality of side-by-side grooves in an outwardly facing side of said garment, said grooves having a depth dimension in said material sufficient to significantly increase the elasticity of said material in said stretch area while maintaining the sufficient mechanical integrity and thermal insulation in said stretch area to permit use of said garment in aquatic activities, wherein the improvement in said garment comprises:

said garment is a suit top having a torso covering portion and two sleeve covering portions extending to positions beyond the user's elbow, said material is a bendable sheet of closed-cell foam, said grooves are provided in said torso portion in stretch areas covering the user's rib cage, and back and proximate the back and sides of the user's waist, and said grooves are provided in each of said sleeve portions in stretch areas proximate the user's elbow and in an area proximate and behind the user's biceps.

27. In a garment formed of a substantially water-impervious material having a thickness dimension sufficient to provide thermal insulation for a user during aquatic activities, said material having a stretch area located in an area of frequent stretching during use of said garment, said stretch area being formed with a plurality of side-by-side grooves in an outwardly facing side of said garment, said grooves having a depth dimension in said material sufficient to significantly increase the elasticity of said material in said stretch area while maintaining the sufficient mechanical integrity and thermal insulation in said stretch area to permit use of said garment in aquatic activities, wherein the improvement in said garment comprises:

said garment is a suit bottom having a waist portion and two leg portions extending to positions below the user's knees, said material is a bendable sheet of closed-cell foam, said grooves are provided in stretch areas in the back and sides of said waist portion, and said grooves are provided in stretch areas in each of said leg portions over the user's thighs and shins.

* * * * *